US005325826A

United States Patent [19]

Cierpial et al.

[11] Patent Number: 5,325,826

[45] Date of Patent: Jul. 5, 1994

[54] JOURNAL BEARING OIL DIVERTER

[75] Inventors: Philip D. Cierpial, Detroit; Matt A. Vance, Dearborn, both of Mich.

[73] Assignee: Ford Motor Company, Dearborn, Mich.

[21] Appl. No.: 145,550

[22] Filed: Nov. 4, 1993

[51] Int. Cl.[5] ..... F01M 9/10

[52] U.S. Cl. ..... 123/90.34; 123/196 M; 384/434; 384/398

[58] Field of Search ..... 123/90.33, 90.34, 90.38, 123/196 R, 196 M; 384/434, 398

[56] References Cited

U.S. PATENT DOCUMENTS

| | | | |
|---|---|---|---|
| 3,958,541 | 5/1976 | Lachnit | 123/90.34 |
| 4,199,202 | 4/1980 | Maeda | 384/434 |
| 4,258,673 | 3/1981 | Stoody, Jr. et al. | 123/90.34 |
| 4,729,349 | 3/1988 | Sonoda et al. | 123/90.34 |
| 4,876,916 | 10/1989 | Maier | 123/90.34 |
| 4,915,067 | 4/1990 | Imajo | 123/90.34 |
| 5,052,351 | 10/1991 | Nishimura et al. | 123/90.34 |
| 5,144,921 | 9/1992 | Clos et al. | 123/90.34 |
| 5,172,663 | 12/1992 | Fujiwara | 123/90.34 |
| 5,186,129 | 2/1993 | Magnan et al. | 123/90.34 |
| 5,273,007 | 12/1993 | Ampferer | 123/90.34 |

FOREIGN PATENT DOCUMENTS

| | | | |
|---|---|---|---|
| 117907 | 5/1989 | Japan | 123/90.34 |

*Primary Examiner*—E. Rollins Cross
*Assistant Examiner*—Weilun Lo
*Attorney, Agent, or Firm*—Donald A. Wilkinson; Roger L. May

[57] ABSTRACT

A mechanism for providing a continuous supply of oil on camshaft lobes used in an overhead cam internal combustion engine. The mechanism includes camshaft bearing caps affixed to the engine about the camshaft journals. Protruding from the side surface of the central portion of the bearing caps are oil diverter pads. The oil diverter pads cause oil that builds up on the surface of the camshaft journals to be diverted toward the camshaft lobes to provide lubrication between the camshaft lobes and the roller finger followers.

11 Claims, 2 Drawing Sheets

JOURNAL BEARING OIL DIVERTER

FIELD OF THE INVENTION

The present invention relates to a device for lubricating the cam lobes of camshafts in an internal combustion engine.

BACKGROUND OF THE INVENTION

A typical concern with valve train lubrication in an internal combustion engine is assuring an adequate supply of oil on the cam lobes while the engine is operating, for all engine conditions. When the camshaft in an overhead cam engine, in particular, is operating, it is critical that the cam lobes are well lubricated. This is typically done using the engine oil. Without adequate oil supply to the cam lobes, the components can overheat and fail. Thus, the supply of oil to lubricate the lobes is critical under all operating conditions and engine speeds, including low engine speeds.

An example of one current method of supplying oil is to allow oil to bleed off out of top holes in lash adjusters through holes in roller finger followers. The oil then flows by the force of gravity along the top surface of the body of the roller finger follower toward the areas in need of lubrication. While this works adequately for some geometries of cam and roller configurations, oil does not always flow properly for all configurations.

Of particular difficulty with the geometry of overhead cam engines is when one of the two sets of valves is located above all but the valve contacting tip portion of the roller finger followers such that gravitational force will cause the oil to flow away from rather than toward the critical areas in need of lubrication. That is, the oil will flow off of the roller finger follower and down to the tappet gallery floor, thus providing no lubrication to the cam lobes and roller of the roller finger follower.

Some attempted solutions to this problem include adding extra oil passages around the cams to supply oil directly to the cam lobes, at the added cost, weight of additional parts and loss of oil pressure in the overall system; or adding parts that force oil to be sprayed onto the cams at the expense of additional parts and the resultant loss of oil pressure in the overall oil system. Thus, the need arises for an oiling mechanism that will assure adequate oil supply to the cam lobes at all engine speeds while not losing oil pressure or adding significant cost increases.

SUMMARY OF THE INVENTION

In its embodiments, the present invention contemplates an oiling mechanism for use in an internal combustion engine having a camshaft which includes a journal portion having oil supplied to its surface and a cam lobe portion. The oiling mechanism is comprised of at least one camshaft bearing member affixed to the engine about the camshaft journal portion. The oiling mechanism is further comprised of a diverter affixed to the camshaft bearing member provided adjacent to the camshaft journal, whereby oil will be diverted from the camshaft journal toward the cam lobe.

An object of the present invention is to provide oil to the camshaft lobes of a camshaft in an engine by providing an oiling mechanism that includes a diverter affixed to the camshaft bearing members.

Accordingly, an advantage of the present invention is providing adequate oil supply to the cam lobes while not adding additional parts to the system.

A further advantage of the present invention is providing this adequate oil supply without losing pressure in the oil system at all engine speeds.

DETAILED DESCRIPTION OF THE PREFERRED EMBODIMENTS

Figure 1:
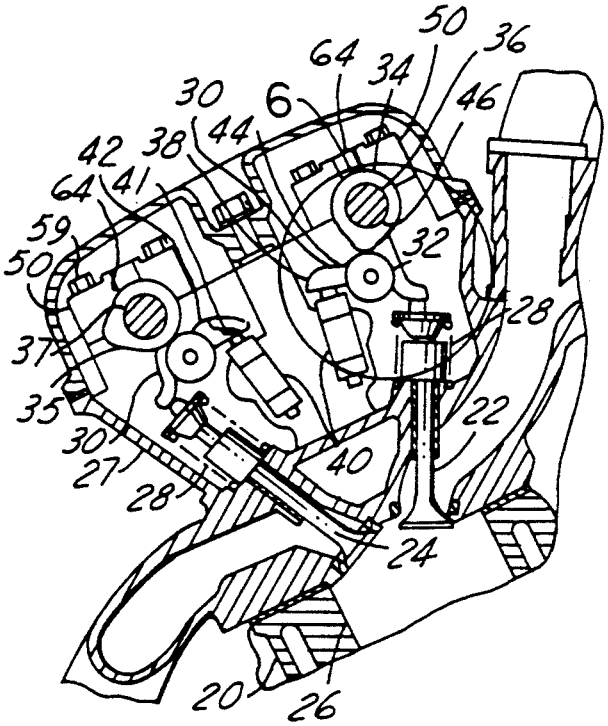
FIG. 1 is an elevation view in partial section of an engine in accordance with the present invention.
Figure 2:
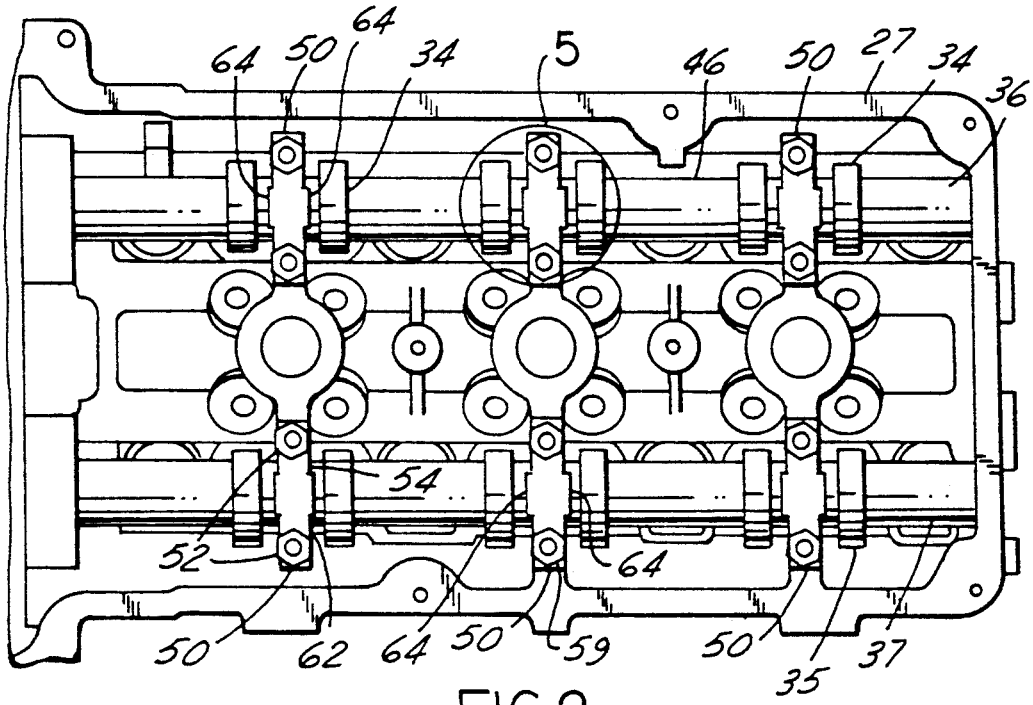
FIG. 2 is a plan view of a cylinder head of a double overhead cam engine, with the lash adjusters not shown, in accordance with the present invention.

Referring to FIGS. 1 and 2, an internal combustion engine 20 is shown having dual overhead camshafts; an intake camshaft 36 and an exhaust camshaft 37. Intake valves 22 and exhaust valves 24, mounted in a cylinder head 27, each have a head located within one of the cylinders 26 of engine 20. Each of the valves 22 and 24 is biased in a closed position with a separate spring 28. The roller finger followers 30 are in surface contact with the back end of each of the valves 22 and 24. Each of roller finger followers 30 has a roller 32, in contact with either an intake cam lobe 34 on the intake camshaft 36 or an exhaust cam lobe 35 on the exhaust camshaft 37, and an adjustment portion 38 in surface contact with a lash adjuster 40. Each of the rollers 32 includes a series of needle bearings 33 to allow the rollers 32 to rotate.

Figure 6:
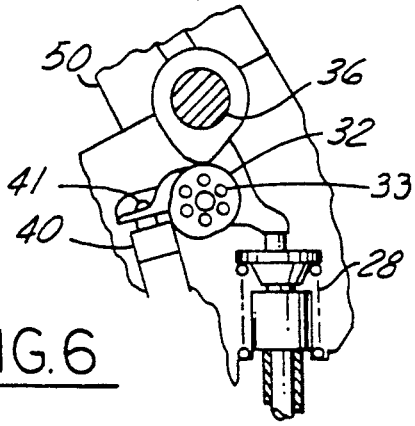
FIG. 6 is an enlarged view of the encircled area 6 in FIG. 1.

Each lash adjuster 40 includes a top hole 41, shown in FIGS. 1 and 6, through which oil bleeds off and then runs along the top surface 42 of the stamped body 44 of the corresponding roller finger follower 30 under a gravitational force. The top holes 41 of the roller finger followers 30 associated with the exhaust valves 24 is vertically higher than the line of contact between the exhaust cam lobes 35 and the rollers 32 while the top holes 41 of the roller finger followers 30 associated with the intake valves 22 is vertically below the line of contact between the intake cam lobes 34 and the rollers 32.

With this engine configuration, then, the oil that bleeds off of the lash adjusters 40 associated with the exhaust valves 24 will then run down to the roller 32 and wet the surfaces of the rollers 32. Thus, the contact between the rollers 32 and the associated intake cam lobes 34 will be constantly wetted with oil. On the other hand, the oil that bleeds off of the lash adjusters 40 associated with the intake valves 22 will run down to the tappet gallery floor, thus providing no lubrication to the intake cam lobes 34 and roller 32 of the roller finger followers 30 from this supply of oil.

Surrounding the top portion of and retaining the camshafts 36 and 37 are camshaft bearing caps 50. The bearing caps 50 are located adjacent to the cam lobes 34 and 35. The bearing caps 50 are nearly in surface contact with the camshaft journal 46; having only about a 0.02 millimeter gap between the two, allowing for a thin film of oil in the gap. The camshaft journals 46 have oil upon their outer surface due to oil leaking from the bearing caps 50.

Figure 4:
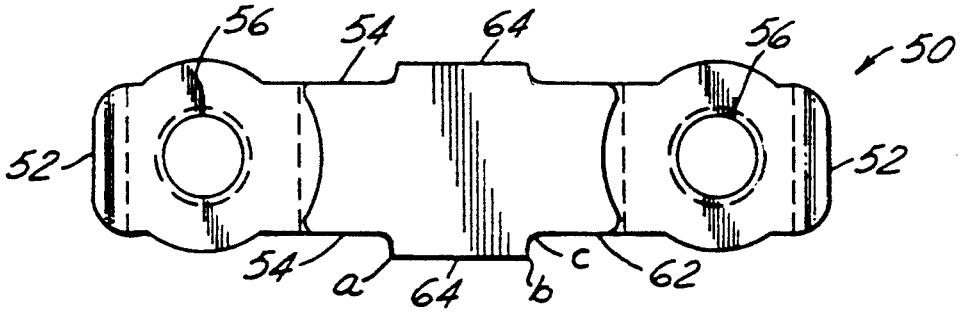
FIG. 4 is a plan view of a camshaft bearing cap in accordance with the present invention.
Figure 3:
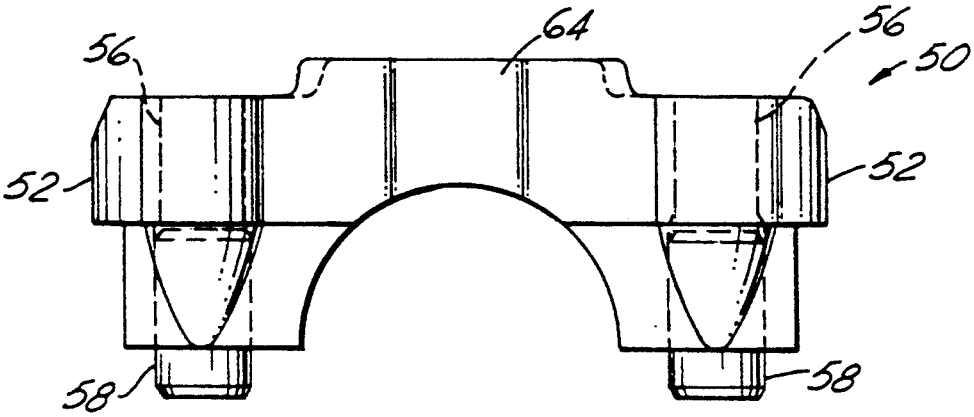
FIG. 3 is a side elevation view of a camshaft bearing cap in accordance with the present invention.

The bearing cap 50 details are further illustrated in FIGS. 3 and 4. Each bearing cap 50 is made up of two end portions 52 and a central portion 54. Each of the end portions 52 has a bore 56 therethrough and a locating dowel 58 protruding from one end of the bore 56. The protruding portion of the locating dowels 58 fit into corresponding bores (not shown) in the engine on either side of the camshaft journal 46, where fasteners 59 can be inserted to install and maintain the bearing caps 50 in place. When installed, a semi-circular bearing surface 60 within the central portion 54 of the bearing caps 50 is approximately 0.02 millimeters from surface contact with the camshaft journal 46 as described above.

The side surfaces 62 of the central portion are generally flat and normal to the direction of rotation of the camshafts 36 and 37. Protruding from each side of the central portion 54 of the bearing caps 50 are oil diverter pads 64. The oil diverter pads 64 preferably extend to and form a part of the semi-circular bearing surface 60. Alternatively, the oil diverter pads 64 can be recessed slightly from the bearing surface 60, so long as this additional gap formed is minimal, allowing oil to still be diverted by the pads 64. The pads 64 are also preferably integral with the camshaft bearing caps 50 for ease of manufacture but need not be.

The width (i.e., the distance from point a to point b, shown in FIG. 4) of a pad 64 has only a small effect upon the flow of oil from camshaft journal 46. Therefore, the width can be determined based upon ease of fabrication and assembly so long as it is wide enough to withstand the forces encountered in operation. Preferably, the width is between 3 and 12 millimeters.

The thickness (i.e., the distance from point b to point c, shown in FIG. 4) of a pad 64 can also vary. In general, the thicker the pad 64, the quicker the oil will be diverted from the surface of the camshaft journal 46 to the cam lobes 34 and 35. The minimum thickness is preferably greater than 1 millimeter; and the maximum thickness is a tradeoff of manufacturing considerations, including fabrication and the space available for the pad 64 to protrude without interfering with the operation of the cam lobes 34 and 35, while still minimizing the time to divert the oil. Preferably, the thickness is between 1 and 3 millimeters.

Also, as an alternative embodiment, a sloped edge (i.e., an angle other than 90 degrees between the side surface 62 of the central portion 54 and a line connecting points b and c) can be used although this reduces the amount of oil that is diverted to the cam lobes 34 and 35. Further, as an alternative embodiment, the bearing caps 50 on the exhaust camshaft 37, as applicable to the geometry of the engine shown in FIG. 1, can be fabricated without the oil diverter pads 64 since the flow of oil due to gravity will wet the surfaces of cam lobes 35; although preferably both camshafts 36 and 37 are secured with bearing caps 50 having oil diverter pads 64. Additionally, the pads 64 can be added directly to the bearing members on the cylinder heads for engines having an integral cam bearing member rather than cam caps.

Figure 5:
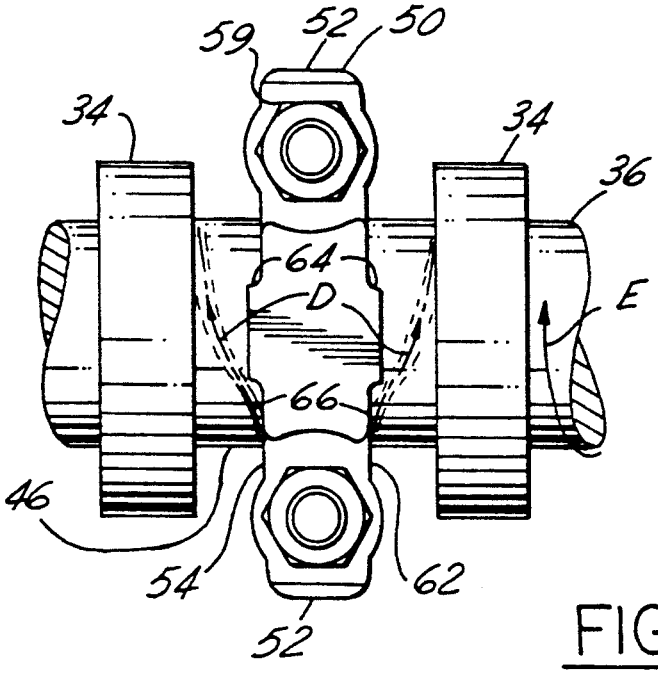
FIG. 5 is an enlarged view of the encircled area 5 in FIG. 2.

FIG. 5 illustrates an example of the oil flow resulting from the diverter pads 64 while the engine is in operation. The camshaft 36 is shown rotating in the direction of arrow E. The oil 64 leaking from the bearing caps 50 builds up on the surface of the camshaft journals 46. The oil diverter pads 64 on the camshaft bearing cap 50, then, causes oil 66 to be diverted from the surface of the camshaft journal 46 substantially axially, arrow D, relative to the rotation of the camshaft 36. This causes oil 66 to flow to the sides of the cam lobes 34, which will, in turn, work its way out to the outer surface of the cam lobes 34 due to centrifugal force to lubricate the surfaces between the cam lobe 34 and the roller and needle bearings of the roller finger follower thereby providing oil 66 where it is needed without causing a change in oil pressure in the engine.

While the best mode for carrying out the invention has been described in detail, those familiar with the art to which this invention relates will recognize various alternative designs and embodiments for practicing the invention as defined by the following claims.

We claim:

1. An oiling mechanism for use in an internal combustion engine having a camshaft which includes a cam lobe portion and a journal portion having oil supplied to a surface of the journal, the oiling mechanism comprising:

at least one camshaft bearing member affixed to the engine about the camshaft journal portion; and a diverter affixed to the camshaft bearing member provided adjacent to the camshaft journal, the diverter comprises at least one oil diverter pad protruding from a portion of the bearing member wherein oil will be diverted from the camshaft journal toward the cam lobe.

2. A mechanism according to claim 1, wherein the bearing member is a camshaft bearing cap.

3. A mechanism according to claim 1, wherein the diverter comprises two oil diverter pads protruding from opposite sides of a central portion of the bearing member.

4. A mechanism according to claim 1, wherein the at least one oil diverter pad protrudes from a bearing member central portion at an angle substantially different from normal to the central portion.

5. A mechanism according to claim 1, wherein the at least one oil diverter pad and the camshaft bearing member are integral.

6. A mechanism according to claim 1, wherein the camshaft bearing member has two spaced end portions affixed to the engine and a central portion therebetween, the diverter is affixed to the central portion of the bearing member.

7. In combination, an internal combustion engine and an oiling mechanism comprising:

a camshaft which includes a cam lobe portion and a journal portion having oil supplied to a surface of the journal;

at least one camshaft bearing member affixed to the engine about the camshaft journal portion; and a diverter affixed to the camshaft bearing member provided adjacent to the camshaft journal, the diverter comprises at least one oil diverter pad protruding from a portion of the bearing member wherein oil will be diverted from the camshaft journal toward the cam lobe.

8. A combination according to claim 7, wherein the diverter comprises two oil diverter pads protruding from opposite sides of a central portion of the bearing member.

9. A combination according to claim 7, wherein the at least one oil diverter pad protrudes from a bearing member central portion at an angle substantially different from normal to the central portion.

10. A combination according to claim 7, wherein the at least one oil diverter pad and the camshaft bearing member are integral.

11. A combination according to claim 7, wherein the bearing member is a camshaft bearing cap.

* * * * *